United States Patent [19]

Hepher

[11] Patent Number: 4,556,481

[45] Date of Patent: Dec. 3, 1985

[54] APPARATUS FOR SEPARATING PARTICULATE MATERIALS

[75] Inventor: Nicholas M. Hepher, Lamberhurst, England

[73] Assignee: Blue Circle Industries plc, London, England

[21] Appl. No.: 551,869

[22] Filed: Nov. 15, 1983

[30] Foreign Application Priority Data

Nov. 17, 1982 [GB] United Kingdom ..... 8232857

[51] Int. Cl.[4] ..... B03C 7/04

[52] U.S. Cl. ..... 209/127; 209/214

[58] Field of Search ..... 209/1, 127 R, 127 A, 209/127 B, 128, 129, 130, 131, 214; 204/164, 180 R, 186

[56] References Cited

U.S. PATENT DOCUMENTS

| | | | |
|---|---|---|---|
| 2,699,869 | 1/1955 | Gear | 209/127 |
| 2,848,108 | 8/1958 | Brastad et al. | 209/127 B |
| 2,848,727 | 8/1958 | Johnson et al. | 15/1.5 |
| 3,162,592 | 12/1964 | Pohl | 209/127 R |
| 3,401,795 | 9/1968 | Tauveron | 209/127 R |
| 3,489,279 | 1/1970 | St. John | 209/130 |
| 3,720,312 | 3/1973 | Shook et al. | 209/127 B |
| 3,739,554 | 6/1973 | Whetten et al. | 209/127 R |
| 3,853,750 | 12/1974 | Volsy | 209/127 R |
| 4,357,234 | 11/1982 | Inculet et al. | 209/127 B |

FOREIGN PATENT DOCUMENTS

| | | | |
|---|---|---|---|
| 464598 | 4/1950 | Canada | 209/127 R |
| 940389 | 12/1948 | France | 209/127 R |
| 831240 | 3/1960 | United Kingdom | 209/127 R |
| 1025688 | 4/1966 | United Kingdom | 209/127 R |
| 1107574 | 3/1968 | United Kingdom | 209/127 R |
| 1161125 | 8/1969 | United Kingdom | 209/127 R |
| 1415311 | 11/1975 | United Kingdom | 209/127 R |
| 2014061 | 8/1979 | United Kingdom | 209/127 R |
| 2087267 | 5/1982 | United Kingdom | 209/127 R |

OTHER PUBLICATIONS

Fraas et al., "Electrostatic Separation of Solids," *Industrial and Engineering Chemistry,* vol. 32, No. 3, pp. 600–604, May 1940.

Inculet et al., "Enrichment of Iron Ore and Other Ores by an Electrostatic Process in a Fluidised Bed, *Chiemie et Industrie-Genie Chimque,* vol. 106, No. 4, Feb. 1973, pp. 245–246.

*Primary Examiner*—Andrew H. Metz
*Assistant Examiner*—Terryence Chapman
*Attorney, Agent, or Firm*—Brooks Haidt Haffner & Delahunty

[57] ABSTRACT

Particles having different properties (e.g. particulate fly ash and carbon) are separated by moving the particles forwards along a horizontal, gas-permeable electrode plate (1) above which is mounted a second electrode (2) having at least one plate (4) mounted at an acute angle ($\alpha$) to the horizontal. Preferably, two plates (4) each extend sideways from a central block (3) of dielectric material. The particles are fluidized, continuously or intermittently, by a gas stream passed upwards through the plate (1), which may be of sintered metal. An alternating electric field is generated between the electrodes (1, 2) by a high voltage AC power source (14). The field lines (16) from each plate (4) curve to the side and impart centrifugal forces to particles charged by friction or conductive induction, which forces separate the lighter, more highly charged particles from the others. The particles may be moved by means of a vibratory transducer (12). Alternatively, the gas-permeable plate may slope downwards in the forward direction allowing the fluidized particles to move in that direction under the force of gravity. The separated particles are collected in bins (13) arranged around the lower electrode (1).

9 Claims, 6 Drawing Figures

APPARATUS FOR SEPARATING PARTICULATE MATERIALS

FIELD OF THE INVENTION

The present invention relates to a method and to an apparatus for separating particles having different properties, in particular to such a method and apparatus whereby electrostatic separation of the particles is effected by means of an alternating electric field.

BACKGROUND OF THE INVENTION

Many techniques are available in industry for the separation of the components of a mixture of particulate solids. For example, where the materials to be separated differ substantially in particle size, separation may be achieved using screens or sieves. In cases where the components of the mixture differ in density, it may be possible to achieve separation using a fluidized bed or by means of froth-flotation. Electrostatic separators are also known, which use high voltage fields to attract or repel particles in order to effect separation of materials whose particles differ substantially in the electric charges acquired through various electrification processes.

British Patent Specification No. 2,099,729A and the corresponding U.S. Pat. No. 4,357,234 (the teaching of which documents is incorporated herein by reference) describe an electrostatic method and an apparatus that can be used to separate particles that have different physical properties, for example conductivity, mass, size or density.

The said method comprises the steps of charging the particles; and driving the particles in a forward direction through an alternating electric field—in particular a field of non-uniform intensity in a direction perpendicular to the forward direction—having field lines curved in the perpendicular direction whereby the particles are subjected to a centrifugal force in the perpendicular direction, the centrifugal force on each particle being dependent on the mass, size and electric charge of the particle whereby different particles are separated along the perpendicular direction.

The said apparatus comprises means for generating an alternating electric field having a predetermined length and width, wherein the field lines are curved in the direction of the width of the field; means for inserting the particles into one end of the electric field at the side away from the curvature of the field lines; and means for driving the particles through the electric field along the length of the electric field.

In a preferred form, that apparatus comprises a first electrode in the form of a metallic plate mounted on a conventional vibratory feeder.

A second electrode, also in the form of a metallic plate, is mounted above the first electrode at an acute angle (typically 12°) thereto in a lateral direction. In operation, the electrodes are connected to a high voltage AC source which produces an alternating electric field between the electrodes. The field lines are curved, owing to the inclination of the second electrode with respect to the first.

A chute is arranged to deliver a mixture of particulate materials on to the upper surface of the first electrode at one end thereof and adjacent the side where there is the least separation between the first and second electrodes.

The vibratory feeder is so arranged as to transport particles along the length of the first electrode.

The particles moving along the length of the first electrode will acquire charges owing to triboelectrication and/or conductive induction. The curved field lines impart a circular motion to the charged particles which has the effect of subjecting those particles to a centrifugal force. Thus the particles will tend to move in a lateral direction specifically in the direction in which the two electrodes diverge.

The higher the charge of a particle (compared with otherwise similar particles), or, for equal charges, the smaller or less dense the particle is, the greater will be the motion in the said lateral direction. For example, if pulverised fly ash (PFA) contaminated with carbon is fed to the apparatus, the heavier, less-charged fly ash particles will deviate little from the path determined by the vibratory feeder, whereas the lighter, more heavily charged carbon particles will tend also to be moved in a lateral direction under the influence of the alternating field. Bins or other receptacles are placed at appropriate points with respect to the first electrode for the collection of PFA-rich fractions and carbon-rich fractions.

Although the above-described apparatus represented a significant advance in the art, it has since been found that its operation can be improved in a number of respects.

One problem encountered with the above-described apparatus is the tendency of very fine particles in the material to adhere to the surface of the first electrode. For example, during the separation of carbon particles from PFA, it would be found that a layer of very fine fly ash rapidly accumulated on the electrode surfaces. Such a layer of material may have a significant effect on the triboelectrification process by which the particles are predominantly charged. It is desirable, therefore, to keep the electrode surfaces substantially clean during the separation process in order to maintain consistent results.

Another problem that has been encountered is the sticking of particles to one another, which renders the separating process less efficient.

When increasing the scale of the apparatus for the processing of large quantities of particulate matter, it has been necessary to employ vibratory transducers that are powerful enough to ensure adequate transport of the matter through the apparatus. This entails not only a high consumption of energy but also high capital costs in the construction of the apparatus and its supporting framework and foundations, as these must be massive enough to withstand the high mechanical demands placed upon them by such powerful vibratory transducers.

SUMMARY OF THE PRESENT INVENTION

The present invention now provides a method of separating particles having different physical properties, which comprises generating an alternating electric field, the electric field having a first region having field lines curved in a first direction generally perpendicular to a given direction; introducing the particles into the field; charging at least some of the particles; and causing the particles to move along the field in said given direction, whereby a charged particle acted upon by the electric field in the said first region is subjected to a force in the said first direction, characterised in that the particles are fluidized within the electric field. The force on the particle tends to separate that particle along that perpendicular direction from particles having different properties. Preferably, the particles fluidized within the electric field are thereby permitted to move along the field in the given direction under the force of gravity.

In preferred embodiments, the electric field has a second region having field lines curved in a second direction generally perpendicular to the said given direction; a charged particle acted upon by the electric field in the said second region will be subjected to a force in the said second direction. In general, the said first and second directions are generally opposite to each other, transversely of the said given direction. Preferably, the said first and second directions are disposed at an angle having a value of from $\pi \pm 0.05$ to $\pi \pm 0.56$ radians, typically $\pi \pm 0.17$ radians, to each other.

The invention also provides an apparatus for separating particles having different properties, which comprises means for generating an alternating electric field, the electric field having a first region having field lines curved in a first direction generally perpendicular to a given direction; means for introducing the particles into the field; and means for causing the particles to move along the field in the said given direction; characterised in that means are provided for fluidizing the particles within the said electric field. Usually, the electric field-generating means and the particle-moving means will be sufficient to ensure that at least some of the particles are charged by conductive induction and/or triboelectrification; however, the provision of additional particle-charging means is not excluded herein.

Preferably, the apparatus is such that the field-generating means comprises a first electrode means providing a first surface; the particle-introducing means is arranged to deliver the particles unto the said first surface of the first electrode means; the particle-moving means is adapted to move the particles along the said first surface in a given direction; and the field-generating means also comprises a second electrode means, providing a second surface and a third surface, and power source means adapted to apply an alternating potential difference between the first and the second electrode means and produce an alternating electric field extending between the said first surface and the said second and third surfaces. The second surface diverges from the first surface to one side of the apparatus, whereas the third surface diverges from the first surface to the other side of the apparatus. Means are provided for fluidizing the particles moving along the said first surface of the said first electrode means.

The particles may be fluidized continuously or intermittently. Preferably, the said first surface of the first electrode means is defined by a gas-permeable plate, means being provided to pass gas through the said first surface towards the particles. Although means such as a vibratory transducer may be provided for driving the particles in the said given direction, it is also possible to arrange the said gas-permeable plate so that it slopes downwards in the said given direction, means being provided for passing gas upwards through the gas-permeable plate at a rate to fluidize particles on the said first surface so that they move in the given direction under the force of gravity.

BRIEF DESCRIPTION OF THE DRAWINGS

In the Figures, like parts are indicated by like numerals.

DESCRIPTION OF THE PREFERRED EMBODIMENTS

Figure 1:
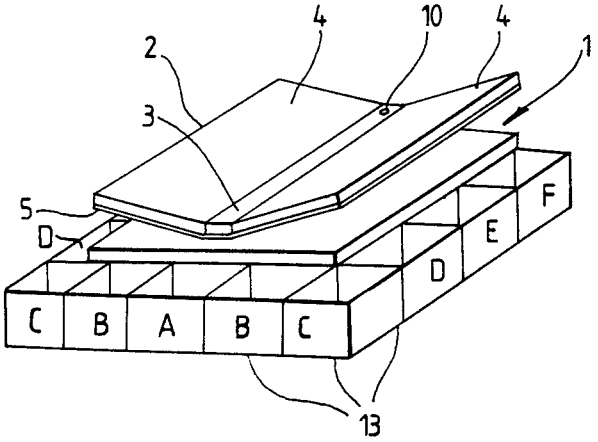
FIG. 1 is a diagram showing, in perspective, the arrangement of the electrodes in an apparatus of the present invention and showing the disposition of receptacles for collecting fractions of materials separated by means of the apparatus.

The exemplary embodiment shown in FIGS. 1–4 comprises a first electrode means 1 in the form of a conductive plate of generally rectangular plan, which plate is mounted substantially horizontally. A second electrode means 2 is mounted above the first electrode means 1 and is spaced from it.

The second electrode means 2 comprises a central member 3 in the form of an elongate block having a substantially rectangular cross-section, the central member extending parallel to the first electrode means in the lengthwise direction. Extending from each of the two long sides of the central member 3 is a wing 4 in the form of a conductive plate. The lowermost surface of the electrode means 2 (i.e. the surface facing the first electrode means) may be provided with a layer 5 of dielectric material.

Each wing 4 is substantially rectangular in plan and has a substantially planar lower surface 6 which subtends an angle $\alpha$ (preferably up to 0.56 radian, especially from 0.1 to 0.28 radian) to the planar upper surface 7 of the first electrode means 1. Thus, the second electrode means has an "inverted roof" structure with the central member 3 at its apex, the two surfaces 6 being disposed at an angle of $\pi+2\alpha$ radians to each other. (Disposing the surfaces 6 at an angle to each other of $\pi-2\alpha$ radians would place the central member 3 uppermost, instead of as illustrated.)

A mixture of particulate materials to be separated may be delivered from a hopper or funnel 8 which communicates via conduit 9 with a bore 10 extending vertically through the central block 3 at one end of the latter. To ensure a proper flow of the material through the conduit 9, a vibratory feeder 11, for example a Syntron (trade mark) feeder, is provided. Of course, an alternative feed device could be used, for example a screw conveyor or an auger feeder.

Material passing through the bore 10 in the central block 3 will fall onto the upper surface 7 of the first electrode means at one end thereof. The first electrode means is mounted on a vibratory transducer 12 (see FIG. 2), e.g. a Syntron device, which is adapted, in operation, to drive the material falling onto the surface 7 from bore 10 in a direction towards the other end of the surface 7 (the "forward direction"). Of course, other means could be employed to move the particulate material along the plate in the forward direction. Bins 13, or other suitable receptacles, are provided and are so placed as to collect particulate material falling over the front edge and side edges of the plate constituting the first electrode means 1.

In operation, a potential difference is applied between the first electrode means and the second electrode means. In the illustrated embodiment, a high-voltage, alternating-current power source 14 is connected to each wing 4 of the second electrode means 2 (see FIG. 3), whereas the first electrode means 1 is grounded (earthed) as indicated at 15. The potential difference will generate an electric field between the first and the second electrode means. In the region of the electric field between the first electrode means 1 and each wing 4, the field lines 16 will be curved (see FIG. 4) owing to the inclination of the wing 4 relative to the first electrode means. As shown, the field lines 16 from either wing 4 curve in a direction perpendicular to the forward direction, i.e. the convex sides of the lines face in the direction in which wing 4 diverges from plate 1.

The permittivity of the material of the central member 3 being greater than that of air, the electric field lines emerging from the innermost edges of the wings 4 will, in general, first penetrate the central member 3 and then descend substantially vertically towards the first electrode means 1. Thus, the field lines under the central member 3 will generally be rectilinear. Nevertheless, it has been found in practice that the particles, during their passage along the first electrode means 1, tend to spread out and sufficient will enter a region of curved electric field lines for effective separation to occur. Thus, the central member 3 helps to effect a gradual introduction of particulate material into the two "centrifugally active" regions of the electric field.

The applied potential difference required for the best result can be readily determined in any case, having regard to the nature of the materials to be separated and the dimensions of the electrode means. The potential difference may be typically within the range of 5 to 30 kV. An appropriate frequency for the power source may also be readily determined for any given case. The frequency will generally be up to 100 Hz, and is typically within the range from 5 to 60 Hz. It has been found that the larger the dimensions of the apparatus, the more suitable are the lower frequencies.

The plates constituting the upper-electrode wings 4 may be fabricated from any appropriate material that is conductive. Metals such as copper, aluminium and steel may be employed; however, as described in greater detail hereinafter, it is also possible to employ conductive liquids.

The upper surface 7 of the first (or lower) electrode means 1 is defined by a gas-permeable plate, for example a perforated or sintered plate of a metal, for example bronze, copper, aluminium or steel. It is important that the upper surface 7 of the first electrode means 1 should remain conductive; thus, it is preferred to employ a material that is resistant to oxidation.

Typical permeability coefficients for the upper surface of the lower electrode means are from $1\times10^{-8}$ to $1.5\times10^{-6}$ cm$^2$. Examplary materials that may be employed as the lower electrode include sintered bronze, for example "Sintercon" (trade name) from Accumatic Engineering Limited or "Porosint" (trade name) from Sheepbridge Sintered Products Limited; sintered stainless steel mesh, for example "Porosint" rigid mesh; sintered carbon tiles, for example Schumacher carbon tiles; and two-layer materials, the upper layer being a woven, electrically conductive mesh (of steel, copper, a metallized plastics material, or the like) having a mesh aperture of less than 1 mm, the lower layer being a sintered plastics material, for example Porvair Vyon.

Figure 2:
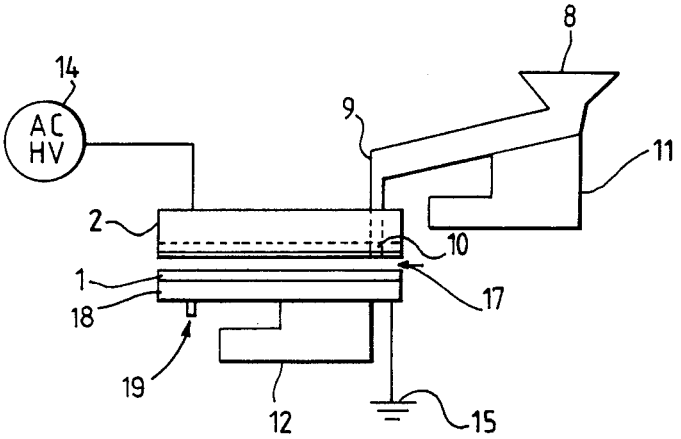
FIG. 2 is a diagram indicating the components of an apparatus according to the present invention, as seen in a side view.

As shown in FIG. 2, the lower electrode 1 forms the top of a plenum chamber 18 having an inlet 19 for a gas, usually air. An air supply may be provided by either a compressor or a blower. Usually, it will be found to be highly desirable to dry the air before it enters the plenum chamber 18; this may be conveniently effected using either a refrigerating dryer or an absorbent chemical, for example silica gel or phosphorus pentoxide. The air is provided typically at a flow-rate through the lower electrode of from 10 to 100 m$^3$/h.m$^2$. The pressure drop across the lower electrode is typically from 10 to 50 mm water gauge. Deflectors (not shown) may be provied within the plenum chamber 18 in order to achieve an even flow of air through the permeable surface 7 of the lower electrode. The gas flow upwards through the surface of the lower electrode may be pulsed or continuous, as appropriate.

The purpose of the dielectric layer 5 (not shown in FIGS. 3 and 4) on the underside of the second electrode means 2 is to reduce the likelihood of electrical breakdown between the first and second electrode means. The relative permittivity (compared to air) of the layer material will generally be 3 or more, typically from 3 to 7. Although, in principle, most insulating materials could be employed (including glass, mica or porcelain), it is preferred for ease of fabrication that the layer material should have good moulding properties. Materials which have proved suitable include natural and synthetic elastomers as well as synthetic resins (plastics), for example silicon rubber, polyamides (e.g. Nylon), epoxy resins, polyesters and fibreglass/polyester composites.

The central member 3 can be fabricated from any of the dielectric materials suitable for the layer 5.

To assist in keeping the upper surface 7 of the lower electrode 1 clean and in order to inhibit the particles from sticking to one another, a slot-shaped nozzle may be positioned at the point indicated by 17 (FIG. 2) to direct a pulsed air stream along the upper surface 7 of the first electrode means 1 in the forward direction below the central member 3. Other means, for example rappers (not shown), may be provided to remove material that adheres to the surfaces of the electrode wings 4 during operation, should the accumulation of such material prove to be a problem.

Figure 3:
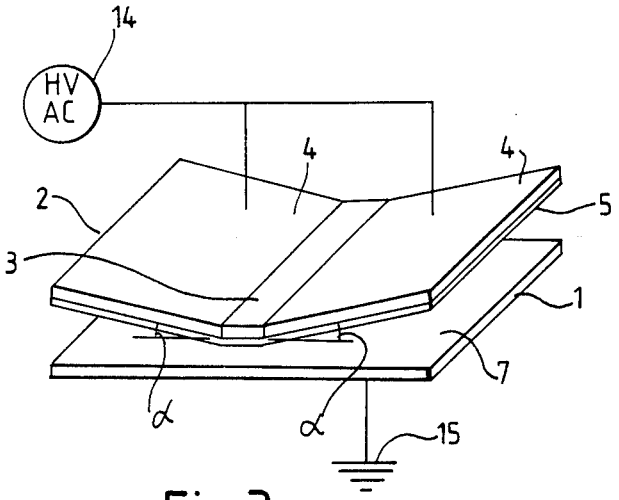
FIG. 3 is a diagram similar to that in FIG. 1, but indicating the electrical connection of the electrode system to the power source.
Figure 4:
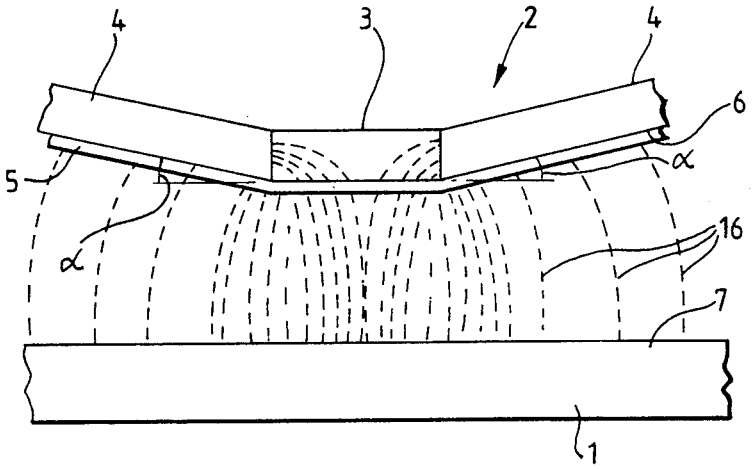
FIG. 4 is a diagram showing part of the electrode system, as seen from the front, and indicating the electric field lines between the electrodes in operation.

It will be understood, of course, that various elements (such as the material supply means 8, 9, 10 and 11, the vibratory transducer 12 and the collecting bins 13) have been omitted from FIGS. 3 and 4 for the sake of clarity.

The operation of the apparatus may be described, by way of an example, with reference to the beneficiation of pulverized fly ash (PFA) contaminated with carbon particles. The contaminated PFA is dumped in the funnel or hopper 8, the power source 14 is connected to the electrode means and the plate constituting the lower electrode 1 is set into vibratory motion by switching on the vibratory transducer 12. The feeder 11 is then switched on in order to convey a stream of the contaminated PFA through a conduit 9 and a bore 10 onto the upper surface 7 of the first electrode means 1. The stream of particulate material is then moved in the forward direction by the transducer 12. Particle individualisation is increased and sticking of the particles is decreased by means of air currents supplied through the nozzle at 17 and through the orifices in the gas-permeable plate 1 constituting the lower electrode.

The carbon particles tend to become much more highly charged than the particles of fly ash, whether the charging be due to triboelectrification, conductive induction, ion or electron bombardment or a combination thereof. Accordingly, the carbon particles are subjected to a greater electrostatic force by the electric field. The oscillatory motion of the carbon particles under the electrostatic force will tend to follow the field lines, which, being curved in a direction perpendicular to the forward direction, will result in a centrifugal force on the carbon particles in that perpendicular direction. Thus, whereas the main mass of fly ash will tend to remain below the central member 3 as it moves along the surface 7, the carbon particles will be urged by the said centrifugal force (or the transverse component thereof) in a lateral direction. As a result, the bins A, B and C (see FIG. 1) will receive ash-rich fractions, whereas the bins D, E and F will receive carbon-rich fractions.

It is possible, of course, to subject the collected fractions to one or more further separating operations using the apparatus of the invention. By means of such a multi-stage separation procedure, it is possible to obtain the desired component or components with a higher degree of purity.

The invention is not limited to the separation of carbon from PFA. In general, it is applicable to the separation of components of a mixture of particulate materials that so differ in properties that one component will be subjected to a significantly higher centrifugal force in the curved electric field. Accordingly, the invention can be used to separate a conductive component from an insulating component, or to separate components that differ significantly in particle mass, size or density.

A method and an apparatus for separating particles employing an upper electrode in the form of an inverted roof, as described above, are the subject of the copending patent application Ser. No. 551,810 claiming priority from British Patent Application No. 8232853, the teaching of which copending application is incorporated herein by reference. However, as implied above, the method and apparatus disclosed in British Patent Specification No. 2,099,729A and U.S. Pat. No. 4,357,234 can also be modified in accordance with the present invention.

It will be apparent that the embodiment illustrated in FIGS. 1–4 can be modified in numerous respects. For example, instead of having just the lower layer 5 of dielectric material, it would be possible to have the electrode plates 4 entirely embedded in, or encapsulated by, an envelope of dielectric material. This may reduce even further the possibility of electrical breakdown. It will be appreciated that any measure that reduces the risk of electrical breakdown will permit the use of higher voltages and/or of shorter distance between the electrodes.

Although, in principle, the plates 4 could be joined at their inner edges, the provision of an intermediate member such as the central block 3 is greatly preferred for two reasons. Firstly, owing to the inclination of the plates 4, the field strength increases as the distance between the plate 4 and the first electrode surface 7 decreases. The central member 3, being of dielectric material, reduces the likelihood of electrical breakdown in the region where there is minimum separation between the first and the second electrode means. Secondly, the size and shape of the cross-section of the central member or block 3 may be selected in order to obtain a desired configuration of field lines below the apex of the second electrode means.

In the embodiment of FIGS. 1–4 the vertical projection of the second or upper electrode means and that of the first or lower electrode means are substantially identical. However, this is not essential and either means could extend beyond the other in a given direction.

Although the plates 4 in the illustrated embodiment are planar, it would be possible for each plate to have a cross-section which followed a curve, provided that the plate still diverged from the upper surface of the lower electrode in order to maintain the curvature of the electric field.

Furthermore, it is not essential to have the upper surface of the lower electrode disposed horizontally. For example, it would be possible to have the upper surface tilting up or down at either side of the longitudinal central line of the first electrode means 1 (i.e. a line immediately below the central member 3). Thus, a shallow V-shape could assist in the retention of the heavier particles on the central portion of the lower electrode during their passage along it. It is also possible to arrange the lower electrode means so that the upper surface thereof slopes downwards in the forward direction; such an arrangement permits the transport of the particles to be assisted by gravity.

It would also be possible to provide a layer of dielectric material on the upper surface 7 of the lower electrode means 1, especially in cases where adequate charging of the particles can be achieved by triboelectrification or ion or electron bombardment (i.e. in cases where conductive induction is not required for particle charging).

As illustrated in FIG. 4, the electric field has a substantially constant cross section in the forward direction and, indeed, this is at present preferred. However, the electrodes could be so arranged as to increase or decrease that cross-section in the forward direction and thereby decrease or increase the field intensity in that direction. Similarly, there may be cases where it is appropriate to have the plates 4 disposed at different angles to the upper surface 7 of the lower electrode.

In preferred embodiments, the electrode arrangement is such that the potential across the first region of the electric field and across the second region of the electric field will vary with distance along the respective perpendicular direction. It has been found that such an arrangement may increase the curvature of the field lines, thereby improving the separation of the particles. Thus, as described in detail in the copending patent application Ser. No. 551,810 claiming priority from British Patent Application No. 8232855—the teaching of which co-pending application is incorporated herein by reference—each electrode wing 4 may be constituted by a body of conductive material of high resistance, the edge of which that is closest to the first electrode means being held at a higher electrical potential than the edge that is furthest from the first electrode means.

Figure 5:
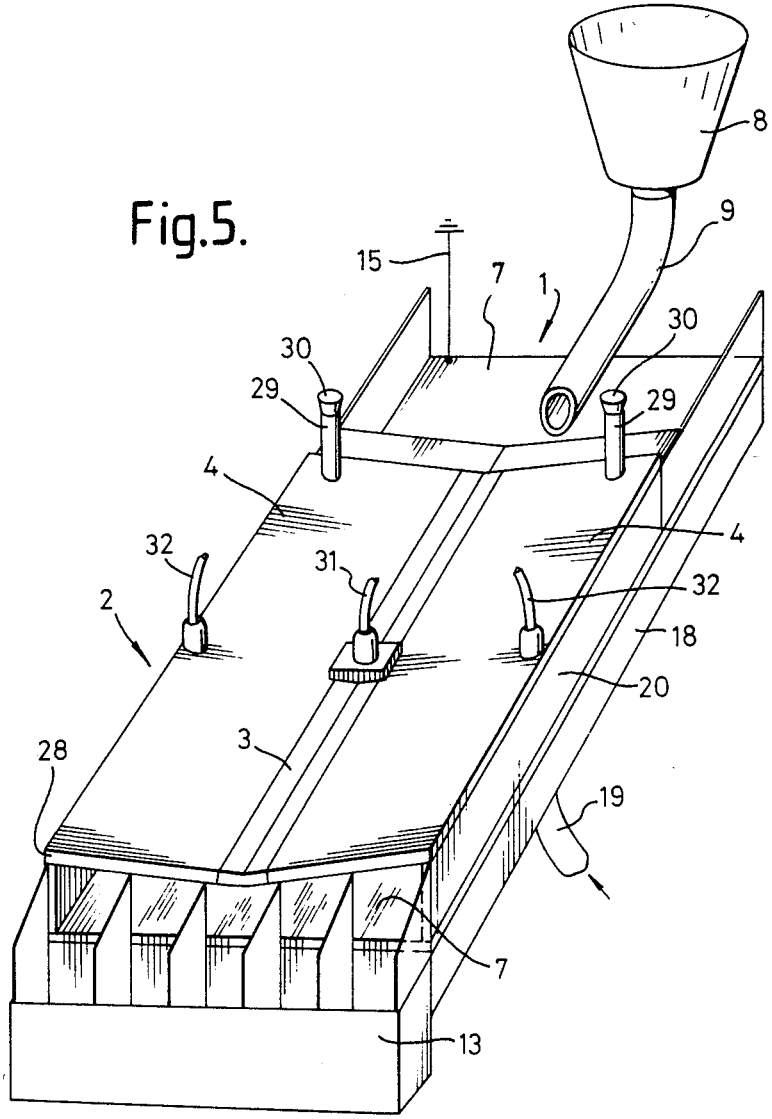
FIG. 5 is a diagrammatic view, shown in perspective, of a further apparatus according to the present invention.

A particularly preferred embodiment of the present invention is illustrated in FIG. 5, which shows an electrostatic separator having a lower electrode 1 in the form of a gas-permeable plate or sheet of sintered metal, such as bronze or steel. The lower electrode 1 constitutes the top of a plenum chamber 18, the bottom and sides of which may be constructed from a rigid plastics material, for example an acrylic resin. An aperture (not shown) is provided in the bottom of the plenum chamber, which aperture is connected, by means of the hose 19, to a source of dried air under pressure. One or more deflectors (not shown) may be provided within the plenum chamber in order to ensure an even flow of air through the sintered metal electrode 1 (which is earthed).

Suitable materials for the lower electrode, suitable air supply means and preferred values of the permeability coefficient, air-flow rate and pressure drop have been disclosed above, with reference to the embodiment of FIGS. 1–4.

The plenum chamber 18 of the apparatus shown in FIG. 5 is arranged and supported so that the planar upper surface 7 of the lower electrode slopes downwards in the forward direction at an angle of 18° to the horizontal. It will be understood, however, that other angles, typically up to 45°, also come into consideration. At each side edge of the lower electrode, there is provided a barrier 20 in the form of a low wall, conveniently formed of a sheet of rigid plastics material. Receptacles 13 are provided at the front of the apparatus for the collection of particulate matter falling over the front edge of the lower electrode 1.

Figure 6:
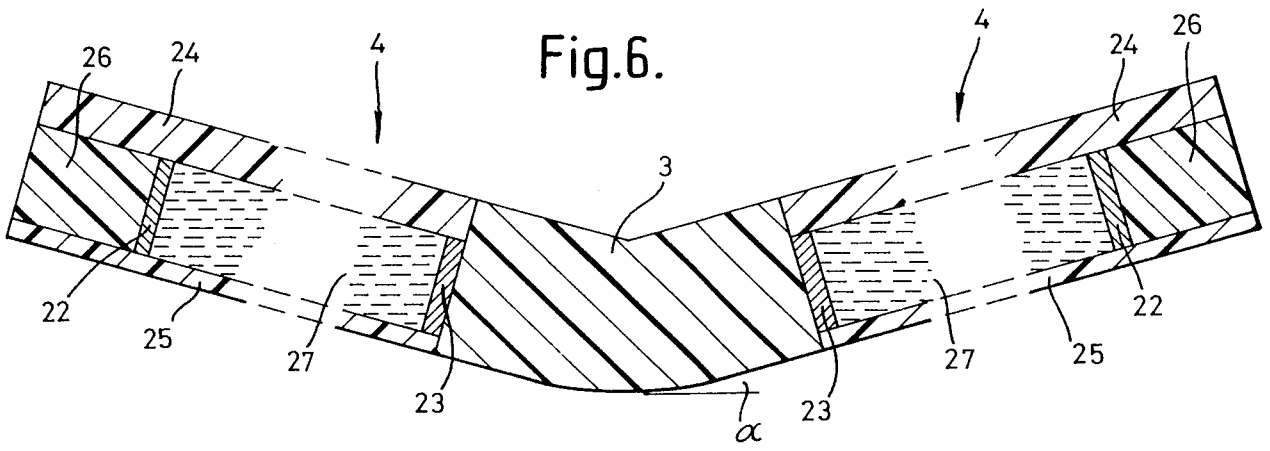
FIG. 6 is a section through the upper electrode of the apparatus of FIG. 5.

The upper electrode 2 (see also FIG. 6) comprises a central member 3 having a substantially chevron-shaped cross section, the lowermost part of which is curved. Extending from either side of the central member 3 is a wing 4 in the form of a box constructed from an upper sheet 24, a lower sheet 25 and an elongate block 26 of rectangular cross-section. The box is completed by front panels 28 and rear panels (not shown) to define a chamber 27, which is filled with a suitable conductive liquid by means of a filling tube 29 provided in the top sheet 24 and communicating with said chamber 27. Each filling tube 29 is provided with closure means, for example a stopper 30. Along the innermost side wall of each chamber 27 there is provided a metal strip 23 which is provided with connector means 31 whereby the two inner metal strips may be connected to a common source of alternating voltage. Similarly, along the outer side wall of each chamber 27 there is provided a further metal strip 22 provided with connector means 32; the two outer connector means 32 are also connected to a common source of alternating voltage which is set at a lower potential than the voltage source to which the inner metal strips 23 are connected. Alternatively, the outer strips 22 may be connected to earth through a suitable resistance. Trials have been effective in which the voltage at the inner metal strips 23 is 15–30 kV and the voltage at the outer metal strips 22 is up to 20 kV. Typical resistivities for the conductive liquid within the electrode boxes are from 1 to 10 Mohm.m. A suitable liquid is transformer oil that has been doped with one or more metal salts to give the required degree of conductivity.

The central member 3 is disposed substantially parallel to the upper surface 7 of the lower electrode, each upper electrode wing 4 being disposed at an acute angle to said upper surface, a typical value for this angle being 10°.

A chute 9 is provided for the delivery of particulate material directly to the upper surface of the part of the first electrode 1 that extends rearwardly of the upper electrode 2. The feed chute 9, which is substantially aligned with the central member 3 of the upper electrode 2, is supplied with the particulate material from a hopper 8. A rearwardly extending, electrically isolated, metal plate 33 is attached to the upper electrode means 2. The purpose of the metal plate 33 being to modify the pattern of electric field lines at the rear of the upper electrode, which field lines might otherwise hinder the entry of the particulate material into the electric field.

In operation, the respective power sources to which the inner metal strips and the outer metal strips of the upper electrode means are connected are switched on, as is the air supply to the plenum chamber 18. The particulate mixture of materials to be separated is then fed through the chute 9 onto the upper surface 7 of the lower electrode 1 at an appropriate rate. The air passing up through the gas-permeable plate constituting the lower electrode 1 will diminish the frictional resistance of the upper surface 7 to the movement of particles across it, thereby permitting the particles to move forward under the force of gravity. As the lower electrode is connected to earth 15, an alternating electric field will be established between the lower and upper electrodes. As explained above, the electric field lines in the region under each wing 4 of the upper electrode will be curved, the curvature of the field lines being enhanced by the potential gradient across each upper-electrode wing 4. Accordingly, as the particulate material moves forward along the surface of the lower electrode, the particles that have acquired an electric charge owing to conductive induction and/or triboelectrification will be subjected to a centrifugal force upon entry into a region of the electric field having curved field lines. The walls 20 will serve to restrain the more highly charged particles from further lateral movement, although such particles will still move forward. Thus, when using the apparatus of FIG. 5 for the beneficiation of carbon-contaminated PFA, the carbon particles will tend to accumulate at each of the walls 20, the resultant carbon-rich fractions being discharged into the outermost receptacles 13, whilst the fractions richest in ash will be collected in the innermost receptacle 13.

The present invention is illustrated in and by the following Example.

EXAMPLE 1

An apparatus was constructed substantially as shown in FIGS. 1–4, except that the upper electrode wings 4 were similar to those described above with reference to FIGS. 5 and 6. Thus, each upper-electrode wing 4 was constituted by a box constructed of acrylic resin, the upper sheets 24 being 5 mm thick, the lower sheets 25 being 1.5 mm thick and the side blocks 26 being 5 mm thick and 2.5 cm wide. The electrode strips 22, 23 were of 1.5 mm thick stainless steel and extended over the length of the chamber 27. Each box defined a chamber 27 that was 85 cm long, 13.5 cm wide and 5 mm deep. Each such chamber was filled with a transformer oil (Diala Oil B from Shell) containing the additive ASA3 (xylene solution) as a dopant; the resistivity of the doped oil was 1.53 Mohm.m.

The lower electrode was fabricated from a sintered bronze sheet (Sintercon Grade A Bronze from Accumatic Engineering Limited), the bronze sheet having a thickness of 5 mm and a permeability coefficient of $1.0\times10^{-8}$ cm$^2$. The sintered bronze electrode had a length of 85 cm and a width of 35 cm and constituted the top of a plenum chamber provided with means for supplying dried air thereto. The lower electrode was connected to earth.

The upper-electrode wings 4 extended from a central block 3 that was 11.5 mm thick at its apex and about 4 cm wide. The angle $\alpha$ subtended by each wing 4 at the upper surface 7 of the lower electrode was 10°, measured in a vertical plane perpendicular to the forward direction.

The electrode separation was 18 mm, this being the vertical distance between the upper surface 7 of the lower electrode means and the lowermost side of the central member 3 of the upper electrode means.

Five sets of experiments were carried out using a standardised carbon-contaminated PFA containing 7.2%±1.0% carbon. The sets of experiments were differentiated by varying the feed rate of the carbon-contaminated PFA.

Before each set of experiments, the apparatus was vacuum cleaned in order to remove any ash adhering to the electrodes. The generator providing the AC field comprised means for selectively varying the frequency of the field from 10 to 200 Hz; for each set of experiments described in this Example a frequency of 50 Hz was selected. The pulsed air system (i.e. the system arranged to deliver jets of air through the slot at 17) was not utilised in these experiments.

The resistance in each oil-filled electrode was 50 Mohm. The AC power supply, which was connected to the innermost metal strips 23 within the oil-filled chambers, was switched on at the start of each experiment, establishing a voltage of the inner edge of each oil-filled electrode of 20 kv. The metal strips 22 at the outer edges of the oil-filled chambers were connected to ground through a resistance of 25 Mohm; during operation, the voltage at the output edge of each oil-filled electrode was 10 kV. The voltage recorded in each case was taken as the root mean square value measured at the upper electrode means.

The power supply to the upper electrode means having been switched on, air was supplied to the plenum chamber at a pressure of 21 mm water gauge. Air passed through the lower electrode plate at a throughput per unit area of electrode of 35 $m^3/h.m^2$.

A sample of approximately 1,000 g of the contaminated PFA was placed in the feed hopper 8 and the associated vibratory feeder 11 was then switched on, as was the vibratory transducer 12 on which the lower electrode was mounted. The particulate material was then passed through the apparatus and the individual fractions collected in the receptacles provided. The fractions were collected, labelled, weighed and stored for subsequent analysis. Prior to the analysis, the samples from receptacles D, E and F were combined to form on high-sample carbon.

The feed rate was calculated from the time required for the vibratory feeder 11 to feed a given mass of contaminated PFA from the hopper 8 into the electrostatic separator.

A conveyor speed of 21 cm/s was employed in each experiment, this being the velocity of the PFA travelling over the lower electrode plate. To measure this, a batch of approximately 10 g of PFA was placed at the rear end of the lower electrode plate and the time required to discharge the batch at the other end of the electrode plate was recorded. No field was applied during the measurement of the conveyor speed (calculated by dividing the length of the lower electrode plate by the recorded time).

The carbon content of a fraction was measured according to the ASTM Standard No. D 3174-73. About 1 gram of the fraction was dried for two hours in a vacuum oven at 105° C. and the sample was then burned for three hours at 750° C. in a porcelain crucible of 35 $cm^3$ volume. The resultant loss of weight in grams was then measured.

The experimental results are summarised in the following Table.

TABLE 1

| Set | 1 | 2 | 3 | 4 | 5 |
|---|---|---|---|---|---|
| Feed rate (kg/hr) | 5 | 11 | 16 | 19 | 30 |
| Feed carbon level (%) | 6.83 | 6.3 | 8.2 | 8.0 | 7.0 |
| Relative mass in fraction (%): | | | | | |
| A | 76.85 | 72.46 | 60.66 | 60.04 | 36.55 |
| B | 17.96 | 20.42 | 32.2 | 34.04 | 48.08 |
| C | 4.46 | 6.42 | 6.44 | 4.98 | 7.46 |
| D + E + F | 0.93 | 0.70 | 0.7 | 0.94 | 7.9 |
| Carbon content in fraction (%): | | | | | |
| A | 2.8 | 2.8 | 4.8 | 4.8 | 3.4 |
| B | 8.5 | 7.3 | 7.36 | 7.46 | 4.76 |
| C | 47.6 | 34.8 | 37.45 | 37.95 | 20.06 |
| D + E + F | 86.3 | 79.5 | 70.34 | 70.52 | 24.93 |

The process in these experiments showed greater selectivity at the lower feed rates.

When a large quantity of material has to be separated, it may be found more efficient to distribute it to several separators of moderate size rather than use a separator of large dimensions.

I claim:

1. A method of separating particles having different physical properties, which comprises generating an alternating electric field, the electric field having a first region having field lines curved convexly in a first direction generally perpendicular to a given direction; introducing the particles into the field; charging at least some of the particles; and causing the particles to move on a surface along the field in the said given direction, whereby a charged particle acted upon by the electric field in the said first region is subjected to a centrifugal force in the said first direction, characterised in that the said surface is gas-permeable and slopes downwards in the said given direction, and in that gas is passed up through the gas-permeable surface whereby the particles are fluidised within the said electric field and are thereby permitted to move along the field in the given direction under the force of gravity.

2. A method according to claim 1, characterised in that the particles are fluidised by a flow of air passing through the gas-permeable surface.

3. A method according to claim 2, characterised in that the air has been dried.

4. A method according to claim 2 or 3, characterised in that the flow rate of the air through the gas-permeable surface is from 10 to 100 $m^3/h.m^2$.

5. An apparatus for separating particles having different properties, which comprises means for generating an alternating electric field, the electric field having a first region having field lines curved convexly in a first direction generally perpendicular to a given direction; means for introducing the particles into the field; means for charging at least some of the particles; and means for moving the particles along the field in the said given direction; characterised in that said particle-moving means comprises a first surface that is gas-permeable and that slopes downwards in the said given direction, means being provided for passing gas upwards through the said first surface at a rate to fluidize the particles within the said electric field and thereby permit them to move in the given direction under the force of gravity.

6. An apparatus according to claim 5, characterised in that the said first surface is defined by a gas-permeable plate.

7. An apparatus according to claim 6, characterised in that the gas-permeable plate is of sintered metal.

8. An apparatus according to claim 6, characterised in that the gas-permeable plate has a permeability coefficient of from $1\times10^{-8}$ to $1.5\times10^{-6}$ $cm^2$.

9. An apparatus according to claim 6, characterised in that means are provided for passing dried air upwards through the gas-permeable plate at a flow-rate of from 10 to 100 $m^3/h.m^2$.

* * * * *